US005530462A

United States Patent [19]

Takahashi et al.

[11] Patent Number: 5,530,462

[45] Date of Patent: Jun. 25, 1996

[54] RECOVERY TECHNIQUE FOR INK JET RECORDING APPARATUS

[75] Inventors: Haruhiko Takahashi, Yokohama; Makoto Takamiya, Kawasaki; Hidejiro Kadowaki, Yokohama; Ken Tsuchii, Tokyo; Masafumi Wataya, Kawasaki; Toshiyuki Yanaka, Tokyo; Kosuke Yamamoto, Yokohama, all of Japan

[73] Assignee: Canon Kabushiki Kaisha, Tokyo, Japan

[21] Appl. No.: 364,019

[22] Filed: Dec. 27, 1994

Related U.S. Application Data

[63] Continuation of Ser. No. 468,070, Jan. 22, 1990, abandoned.

[30] Foreign Application Priority Data

Jan. 24, 1989 [JP] Japan ..... 1-013279

[51] Int. Cl.[6] ..... B41J 2/165

[52] U.S. Cl. ..... 347/23

[58] Field of Search ..... 347/19, 23, 30, 347/24, 29; B41J 2/165

[56] References Cited

U.S. PATENT DOCUMENTS

| | | | |
|---|---|---|---|
| 4,489,335 | 12/1984 | Watanabe et al. | 346/140 R |
| 4,493,993 | 1/1985 | Kanamuller et al. | 250/222.1 |
| 4,540,996 | 9/1985 | Saito | 346/140 R |
| 4,590,482 | 5/1986 | Hay et al. | 346/1.1 |
| 4,668,965 | 5/1987 | Tanaka et al. | 346/140 R |
| 4,692,777 | 8/1987 | Hasumi | 346/140 R |
| 4,745,414 | 5/1988 | Okamura et al. | 346/140 R |
| 4,791,435 | 12/1988 | Smith et al. | 346/140 R |
| 4,931,955 | 6/1990 | Okabayashi et al. | 364/519 |
| 4,947,191 | 8/1990 | Nozawa et al. | 346/140 R |
| 5,040,000 | 8/1991 | Yokoi | 347/30 |

*Primary Examiner*—Benjamin R. Fuller
*Assistant Examiner*—Alrick Bobb
*Attorney, Agent, or Firm*—Fitzpatrick, Cella, Harper & Scinto

[57] ABSTRACT

A recovery method of an ink jet apparatus includes the steps of discharging ink for recovery from a plurality of discharge openings prior to recording, detecting a discharge condition for each discharge opening, and selectively discharging ink for recovery from the discharge openings detected to be unsatisfactory.

18 Claims, 5 Drawing Sheets

RECOVERY TECHNIQUE FOR INK JET RECORDING APPARATUS

This application is a continuation of application Ser. No. 07/468,070 filed Jan. 22, 1990, now abandoned.

BACKGROUND OF THE INVENTION

1. Field of the Invention

The present invention relates to a liquid jet recording apparatus (an ink jet recording apparatus) and recover apparatus therefor, and more particularly to a liquid jet recording apparatus or the like capable of preventing the clogging of the recording head and effecting idle ink discharge (preliminary ink discharge) for removing the clogging in reasonable fashion.

2. Related Background Art

Ink jet recording apparatus for recording characters or images by dot matrix pattern by discharging recording liquid from a recording head onto a recording material such as paper or plastic sheet have the advantages of lower noises in operation in comparison with other recording apparatus, and of basically simple and inexpensive mechanical structure, and are widely employed as recording units for computers, word processors or the like.

In such ink jet recording apparatus, since the recording is achieved generally by discharging the recording liquid (ink) directly from a discharge port or opening (orifice) of the recording head, there is required particular consideration, unlike other recording apparatus, in order to maintain the recording head always in a state capable of ink discharge.

Since ink remains in the discharge port of the recording head even in the non-recording state, there is required means for preventing deterioration of ink in the discharge port such as drying of ink or increase of viscosity by evaporation, and, for this purpose there is already known an apparatus equipped with so-called capping means for preventing drying or evaporation of ink by covering the discharge port of the recording head with a cover in the non-recording state.

However, in low humidity condition or in between long periods of operation, the viscosity increase of ink cannot be prevented by the above-mentioned drying preventing means only, and there has been employed, in combination with said capping means, a discharge recovery mechanism for discharging the deteriorated ink from the discharge port The discharge recovery mechanism sucks the air from the cap covering the recording head thereby extracting ink from the discharge port by a negative pressure generated in said cap, or by pressurizes the discharge port for example with a pump.

However, such a recovery mechanism may still result in deterioration of ink in the discharge ports not used in the course of recording operation, since it is automatically activated for example at the start of power supply, and is not activated in the course of recording operation except for the case of a major discharge failure. In an apparat,us with plural discharge ports in the recording head, certain discharge ports are scarcely used according to the statistical nature of the data to be recorded, and the interval of ink discharge becomes very long in such discharge ports. Therefore, in discharge ports which are used only a limited number of times or have a long interval of ink discharge, the ink tends to exhibit viscosity increase resulting from drying, depending on the ambient conditions such as humidity or temperature, thus resulting in unstable ink discharge or absence of discharge.

In order to prevent such ink discharge failures, there is proposed so-called idle or preliminary ink discharge in which the recording head is brought to a non-recording position and the ink is discharged from the recording head.

In the conventional ink jet recording apparatus, said idle ink discharge operation is conducted on all the discharge ports at a predetermined constant interval. Consequently, the idle discharge is conducted even on properly operable discharge ports, thus increasing the ink consumption.

Such increased ink consumption limits the number of idle ink discharge operations, whereby the clogging is not completely removed, and certain discharge ports may therefore remain in a defective state.

Also the presence of such incomplete discharge ports cannot be detected, so that a recording operation in such state results in defects in the recorded image, such as a lack of recording or uneven density.

SUMMARY OF THE INVENTION

It is an object of the present invention to provide the ink jet apparatus and recover apparatus therefor capable of recovering or preventing the bad discharge securely and effectively while using a small quantity ink.

DESCRIPTION OF THE PREFERRED EMBODIMENTS

Now the present invention will be clarified in detail by an embodiment thereof shown in the attached drawings.

Figure 1:
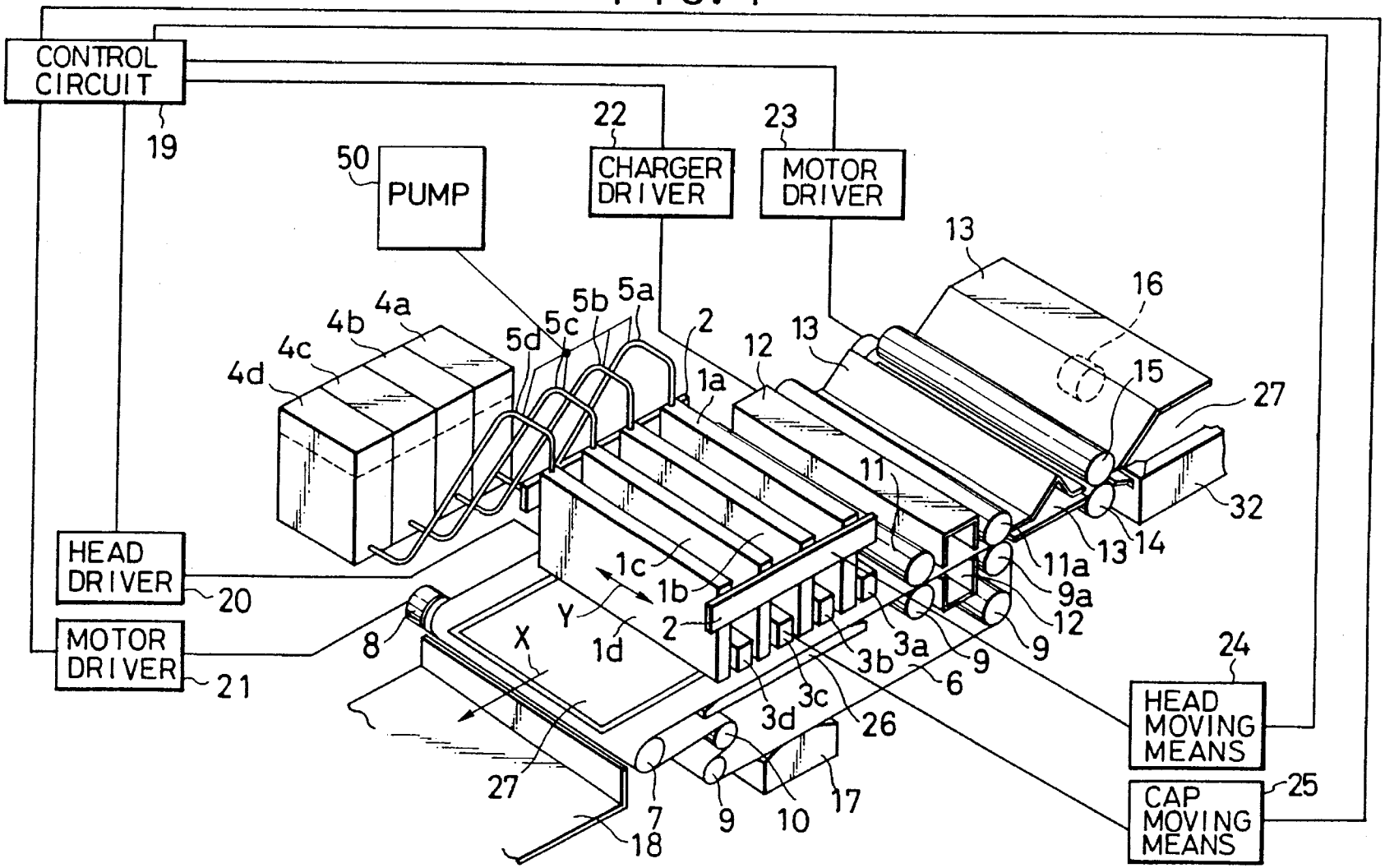
FIG. 1 is a perspective view showing essential portions of the ink jet apparatus according to the present invention.

FIG. 1 is a perspective view showing the essential part of ink jet apparatus according to the present invention.

Linear recording heads 1*a*–1*d* are fixedly supported, in mutually parallel manner with a predetermined distance in a direction X, by a holder 2. Each of the recording heads 1*a*–1*d* is provided, on a lower face thereof, with 3,456 downward discharge ports arranged in a linear array along a direction Y, with a density of 16 ports/mm, thereby enabling recording over a width of 216 mm.

Said recording heads 1*a*–1*d* are of the type effecting the discharge of recording liquid by thermal energy, and are controlled by a head driver 20. Said recording heads 1*a*–1*d* and the holder 2 constitute a head unit, which is vertically movable by head moving means 24.

Head caps 3*a*–3*d*, therein housing ink absorbing members such as sponges are provided respectively to the heads 1*a*–1*d* and are positioned adjacent to the lower part thereof.

Said caps are supported by a holder (not shown) which constitutes a cap unit in combination with said caps 3*a*–3*d*. Said cap unit is rendered movable in the X-direction by cap moving means 25.

Said recording heads 1*a*–1*d* respectively receive cyan, magenta, yellow and black inks from ink tanks 4*a*–4*d* through ink supply tubes 5*a*–5*d*, for recording a full-color image.

The ink supply utilizes the capillary action of the ink discharge ports of the recording head, and the liquid level of each ink tank is maintained lower, by a predetermined distance, than the position of the discharge ports.

A chargeable seamless belt 6 is provided for feeding a recording sheet 27 serving as the recording material. Said belt 6 is guided along a predetermined path by means of a driving roller 7, idler rollers 9, 9*a* and a tension roller 10, and is driven by a belt driving motor 8 connected to said driving roller 7 and controlled by a motor driver 21.

Said belt 6 runs along the X-direction beneath the discharge ports of the recording heads 1*a*–1*d*, and is prevented from downward displacement by a fixed support member 26. A cleaning unit 17 is provided for removing paper dusts or the like present on the surface of the belt 6.

A charger 12 for electrostatically charging the belt 6 is on-off controlled by a charger driver 22, and the recording sheet is attracted to the belt 6 by an electrostatic attractive force created by the charging. In front of and behind the charger 12 there are provided pinch rollers 11, 11*a* for maintaining the recording sheet 27 in contact with the belt 6, in cooperation with said idler rollers 9, 9*a*.

A sheet cassette 32 contains recording sheets 27, which are advanced one by one by a sheet feeding roller 16 driven by a motor driver 23. Said sheet is fed in the X-direction toward a heaped guide member 13, by means of a transport roller 14 driven by said driver 23 and a pinch roller 15. Said guide member has a heaped part for accommodating the bend of the recording sheet. A sheet tray 18 is provided for receiving the recording sheet after recording.

The above-mentioned head driver 20, head moving means 24, cap moving means 25, motor drivers 21, 13 and charger driver 22 are all controlled by a control circuit 19.

Figure 2:
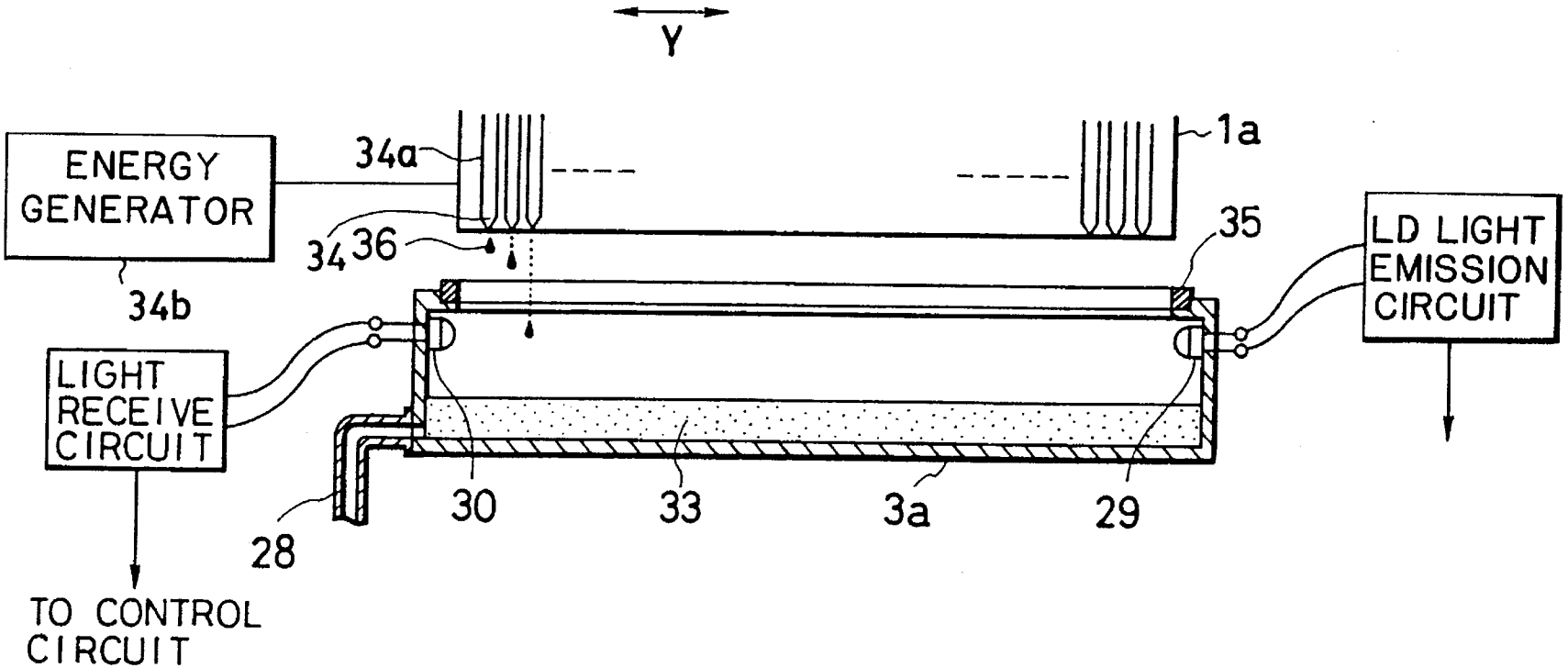
FIG. 2 is a schematic lateral cross-sectional view showing the recording head and the cap in the idle discharge operation in an embodiment of the present invention.

FIG. 2 is a schematic side cross-sectional view of the recording head and the cap in the present embodiment.

As shown in FIG. 2, the recording head 1*a* is provided with a plurality of downward discharge ports 34, arranged with a constant pitch along the Y-direction. In an ink path 34*a* energy generating means 34*b*, such as an electric-thermal converter or an electric-mechanical converter, generates energy to discharge the ink and is in communication with each ink path.

Around the upper aperture of cap 3*a* there is provided a rubber member 35 for engaging with the lower part of the recording head 1*a*. In said cap 3*a* there is provided an absorbing sponge member 33 for absorbing ink droplets 36 discharged, by idle discharge operation, from the discharge ports 34 of said recording head 1*a*. A tube 28 is provided for guiding the used ink, passing through said absorbing member, to a ink tank (not shown).

A laser diode 29 is driven by an LD light emission circuit which is controlled by the control circuit. A photodiode 30 is driven by a light receiving circuit which is also connected to said control circuit.

In the idle discharge operation, said laser diode 29 and the photodiode 30 are activated, whereby the laser beam from said laser diode 29 enters the photodiode 30. The ink droplet 36 of the idle discharge scatters the laser beam upon crossing said beam, whereby the light receiving circuit shows a change in the output thereof, thus detecting the ink droplet.

The foregoing explanation on the recording head 1*a* and the cap 3*a* also applies to the recording heads 1*b*–1*d* and the caps 3*b*–3*d*.

The optical detection of the ink droplet is not necessarily limited by the combination of a laser diode and a photodiode, but for example by a combination of a light-emitting diode and a photo-transistor. Also the light emitting element and the light-receiving element need not be mounted on the cap but may be mounted on suitable positions in the vicinity of both ends of each recording head for achieving the same effect.

Figure 3:
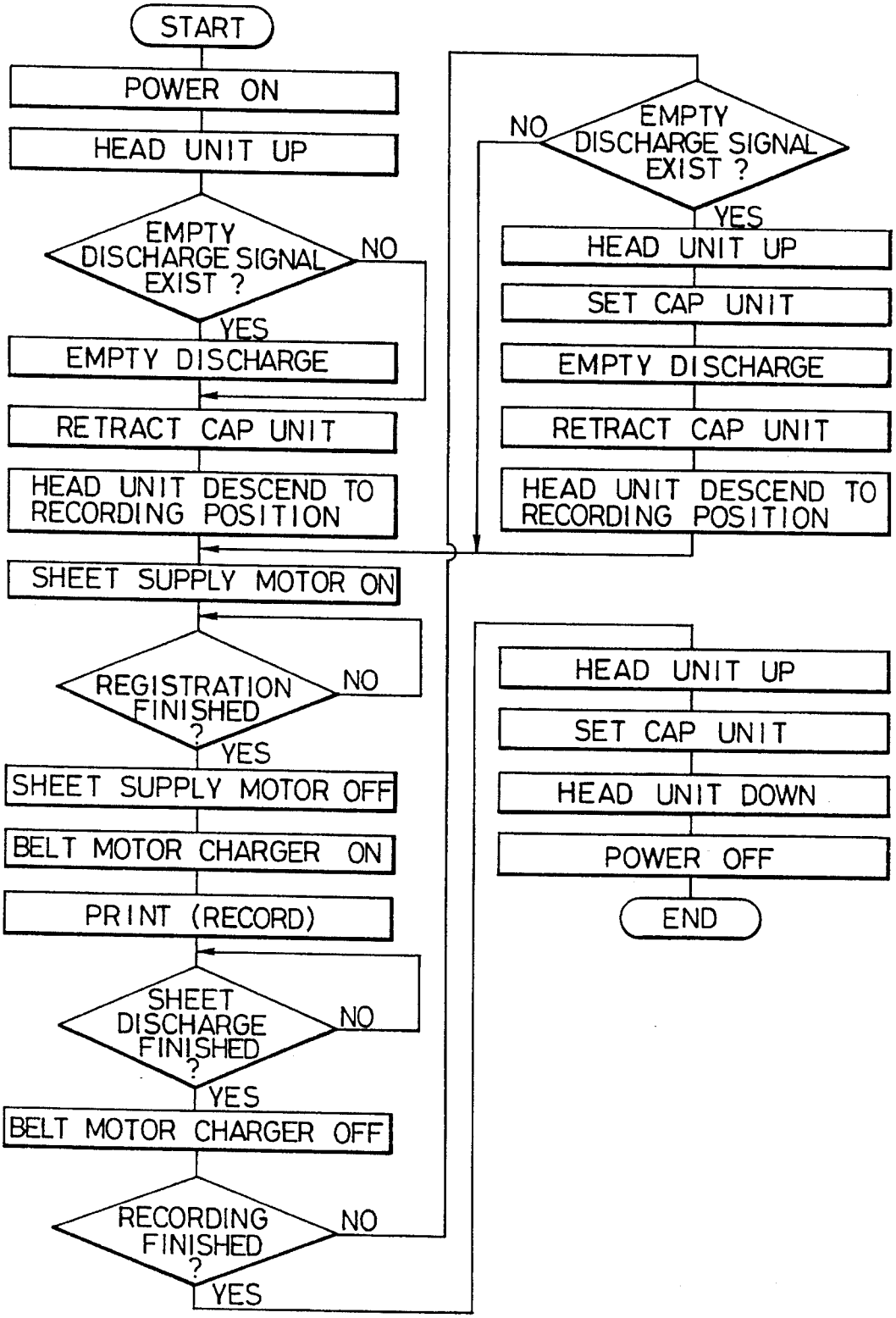
FIG. 3 is a flow chart showing the function of an embodiment of the present invention.

In the following there will be explained the function of the present embodiment, with reference to flow charts shown in FIGS. 3 and 4.

FIGS. 5A to 5D are schematic lateral views showing various operational states of the heads 1*a*–1*d* and the caps 3*a*–3*d* in the present embodiment.

Figure 5A:
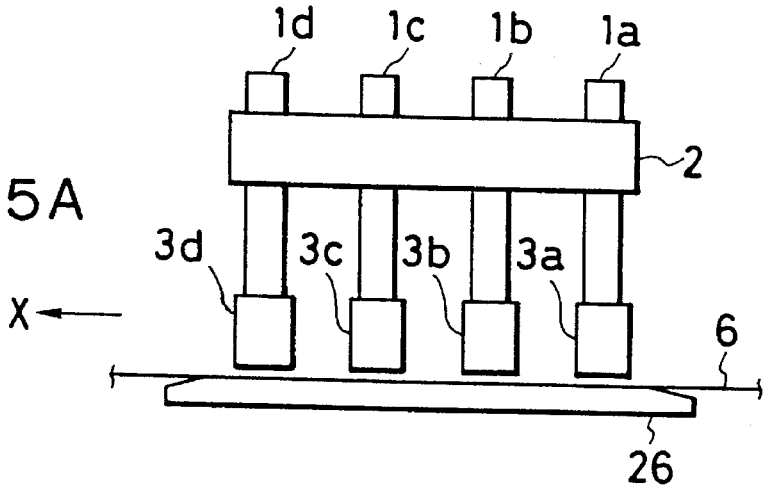
FIGS. 5A to 5D are schematic side views showing various states of the head and the cap in an embodiment of the present invention.

FIG. 5A shows a state with turned-off power supply, in which the recording heads 1*a*–1*d* are lifted upwards and the caps 3*a*–3*d* are shifted in the X-direction to under the recording heads, from the state shown in FIG. 1. Said caps 3*a*–3*d* are respectively attached to the recording heads, thereby preventing the evaporation of ink from the discharge ports of the recording heads.

Figure 5B:
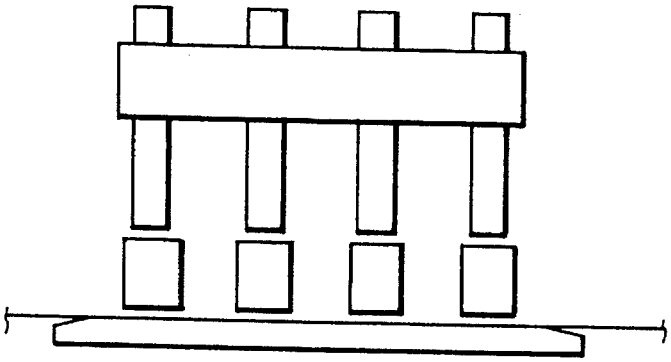

When the power supply is turned on in this state, the head unit is lifted, as shown in FIG. 5B, by about 1 mm by the head moving means 24 (assuming a position as shown in FIG. 2).

If an idle discharge signal is given in this state, idle ink discharges of a predetermined number are effected from all the discharge ports, for preventing or resolving the clogging of the ports.

Figure 4:
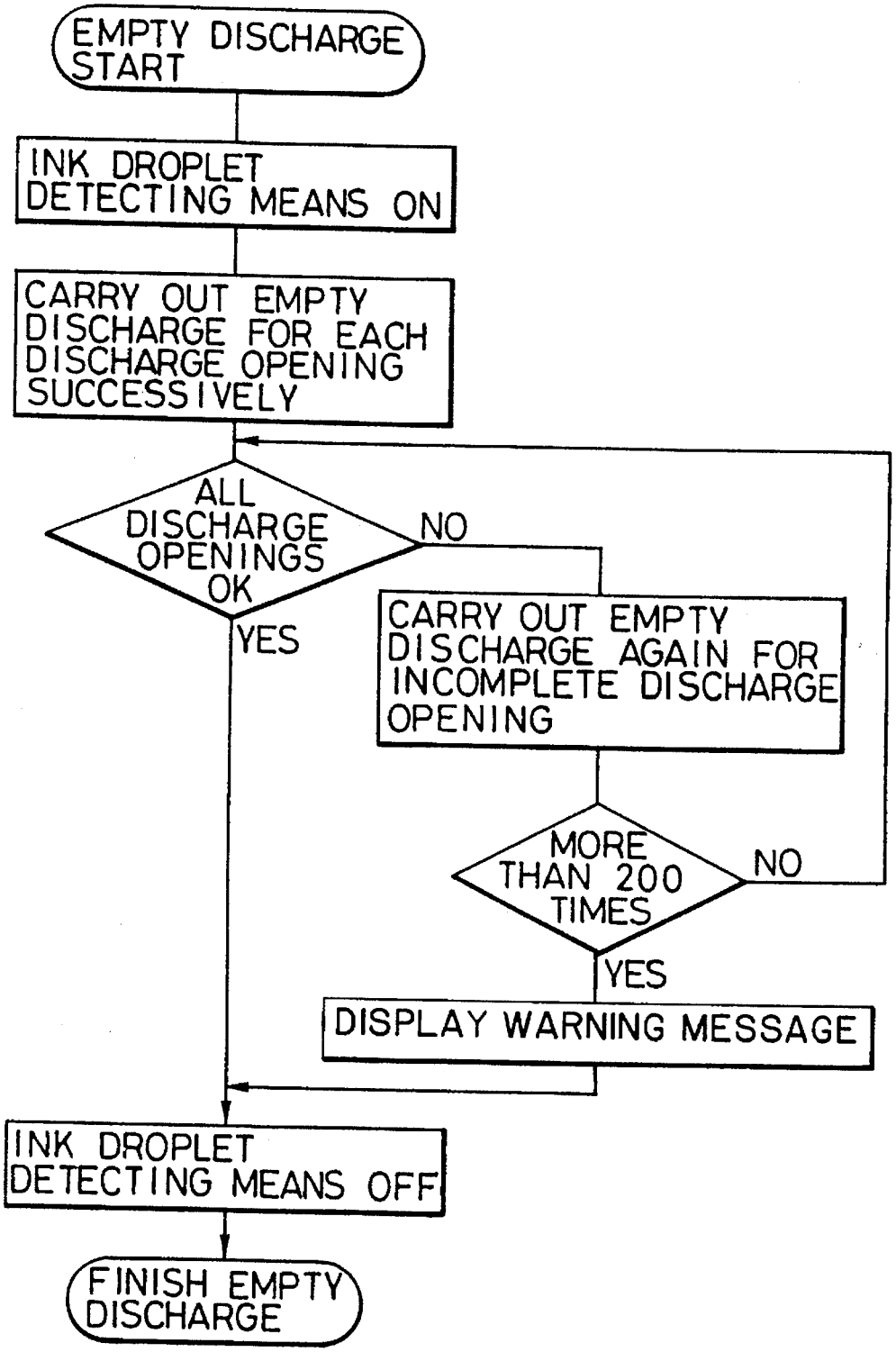
FIG. 4 is a flow chart of the idle ink discharge of an embodiment of the present invention.

FIG. 4 is a flow chart of the idle discharge in the present embodiment.

After the idle discharge operation is started, the aforementioned ink droplet detecting means is activated, and the ink is discharged from the discharge ports in succession, starting from an end port.

For a standard ink discharge speed of about 8 m/s and a distance of 5 mm from the front end of the discharge port to the laser beam, the ink droplet is detected, in the standard state, at 625 μs after the discharge, and this time is taken as the standard delay time.

Since the ink discharge speed usually fluctuates about 10%, 750 μs corresponding to 120% of the standard delay time is regarded as a limit. A discharge failure is identified if the ink droplet is not detected within said time limit, and the number of the discharge port showing such discharge failure is memorized. After an ink discharge from each of the discharge ports, if all the ports are in the normal state, the ink droplet detecting means is switched off and the idle discharge operation is terminated.

If discharge failure is identified in certain discharge ports in the above-explained idle discharge operation, the idle discharge is repeated only on the ports of the memorized numbers until the normal state is restored.

Usually the normal state can be restored by the idle discharges not exceeding 200 times. Thus, if the normal state cannot be reached even after 200 idle discharges, there is displayed a warning message requesting the cleaning of the recording head. Then the ink droplet detecting means is turned off, and the idle discharge operation is terminated.

The discharged ink is absorbed by the absorbing member 33 in the cap.

For effecting the recover of 2 discharge port which has not been recovered even after the recover operation of bad discharge for selectively effecting the idle discharge after the idle discharge from all of the discharge opening, it is preferable to effect the recover process continuously.

Summing up, in the case where there is a discharge opening suffering from bad discharge upon detection of the ink droplet at the time when the selective idle discharge has been finished, a pressure recover process or absorb recover process can be applied. In the former, the ink is pressurized to be supplied from the ink supply side of the head to inside of the head and to be discharged into the cap from the discharge port by usage of a pump 50 (shown schematically) provided in the course of the supply tubes 5*a*–5*d* with a state the cap 35 being opposed to the discharge opening of the head 1*a*. In the latter, negative pressure is generated in the cap by a pump (not shown) provided in the course of discharge ink tube 28 with a state the cap 35 being abutted to the discharge port surface of the head la to cover the discharge port, thereby absorbing the ink via the discharge opening.

In a full-line type head in which the discharge openings are disposed like a line over whole width of the recording area of material to be recorded, the former is desirably adopted for the pressure recover process.

Figure 5C:
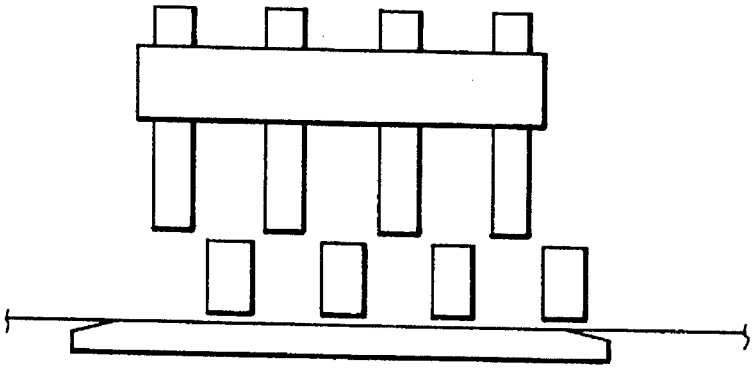
Figure 5D:
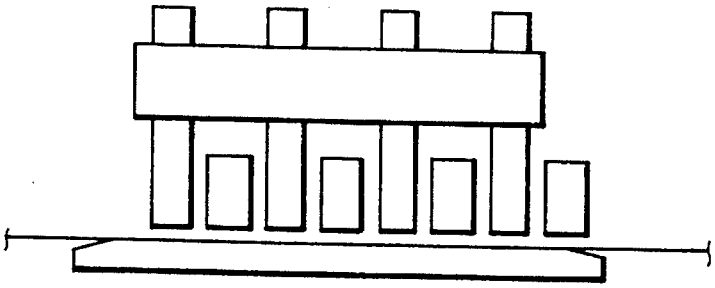

Subsequently, as shown in FIG. 5C, the cap unit is retracted to a predetermined position in a direction opposite to X by the cap moving means 25, and, as shown in FIG. 5D, the head unit is lowered by the head moving means 24 to a predetermined recording position, which is about 1 mm above the belt 6.

Then the motor driver 23 activates the sheet feeding motor, thereby rotating the feeding roller 16 and the transport roller 14, thus feeding a recording sheet 27 from the cassette 32. The front end of said recording sheet passes over the heaped guide member 13, then reaches the position of the pinch roller 11*a* and impinges on the nip between said pinch roller 11*a* and the belt 6 on the idler roller 9*a*, whereby said front end of the recording sheet is adjusted to a perpendicular position in the X-direction. Thus, said pinch roller functions as a registration unit, and, in said registration, a part of the recording sheet advanced excessively by the transport roller 14 is accommodated in a looped state in the space of said heaped guide member 13.

After the lapse of a predetermined time from the passing of the front end of the recording sheet over the heaped guide member 13, said registration operation is completed and the sheet feeding motor is turned off.

Then, the motor driver 21 activates the belt motor 8 to start the rotation of the driving roller 7, and the charger driver 22 activates the charger 12. Thus, the recording sheet 27 after said registration is attracted by the belt 6 charged by the charger 12, and is transported in the X-direction.

Upon arrival of the front end of the recording sheet 27 beneath each of the recording heads 1*a*–1*d*, said head starts ink discharge by the head driver 20, whereby color recording is made on said recording sheet 27 by line-sequential scanning of said recording heads.

Subsequently, the front end of the recording sheet 27 reaches the position of the driving roller 7, separated from the belt by curvature, and the sheet is discharged onto the sheet tray 18. After the sheet is discharged, said belt motor 8 and the charger 12 are turned off.

The recording operation for a recording sheet 27 is thus completed.

If the recording of a series of information is completed, there are conducted the lifting of the head unit, the setting of the cap unit for bringing the caps beneath the recording heads, and the lowering of the head unit in the inverse order to those explained in relation FIG. 4. Thereafter, the power supply is turned off to terminate all the operations.

On the other hand, if the recording of all the information is not yet complete at the end of recording of a sheet, there is discriminated the presence of the idle discharge signal, and, if said signal is absent, there are executed the aforementioned steps starting from the activation of the sheet feeding motor. On the other hand, if said signal is present, there are executed the steps of lifting of the head unit, setting of the cap unit, execution of the idle discharge, retraction of the cap unit, and lowering of the head unit to the recording position. Subsequently there are executed the above-mentioned steps starting from the activation of the sheet-feeding motor, thereby executing the next recording.

Although the preferable embodiment of the present invention has been explained, it is needless to say, the present invention is not limited to such embodiment. For example, in the above embodiment, a single pair of ink droplet detecting means is provided to discharge the ink sequentially from plural discharge openings to thereby detect the discharge openings suffering from bad discharge, but it is possible to provide or arrange plural ink droplet detecting means corresponding to each of plural discharge openings. From the viewpoint of simplicity of apparatus, the former is most desirable.

According to the present invention, since the bad discharge can be recovered or prevented accurately and effectively with a relatively small quantity of consumption ink, the present invention is most desirable for so-called full-line type head in which the discharge openings are arranged over whole width of recording area of the material to be recorded. In this case, the mechanism and construction shown in FIG. 5 is preferable because of its security as well as simplicity.

The present invention brings about excellent effects particularly in a recording head, recording device of the bubble jet system among the ink jet recording system.

As to its representative constitution and principle, for example, one practiced by use of the basic principle disclosed in, for example, U.S. Pat. Nos. 4,723,129 and 4,740,796 is preferred. This system is applicable to either of the so called on-demand type and the continuous type. Particularly, the case of the on-demand type is effective because, by applying at least one driving signal which gives rapid temperature elevation exceeding nucleus boiling corresponding to the recording information on an electricity-heat converters arranged corresponding to the sheets or liquid channels holding liquid (ink), heat energy is generated at the electricity-heat converters to effect film boiling at the heat acting surface of the recording head. Consequently, the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferable discharge of the liquid (ink) with particularly excellent response characteristics. As the driving signals of such pulse shape, those as disclosed in U.S. Pat. Nos. 4,463,359 and 4,345,262 are suitable. Further, excellent recording can be performed by employment of the conditions described in U.S. Pat. No. 4,313,124 of the invention concerning the temperature elevation rate of the above-mentioned heat acting surface.

As the constitution of the recording head, in addition to the combination constitutions of the discharging orifice. The liquid channel, and the electric-heat converter (linear liquid channel or right angle liquid channel) as disclosed in the above-mentioned respective specifications, the constitution by use of U.S. Pat. Nos. 4,558,333 and 4,459,600 disclosing the heat acting portion arranged in the flexed region is also included in the present invention. In addition, the present invention can be also effectively made by the constitution disclosed in Japanese Patent Laid-Open Application No. 59-123670, which discloses using a slit common to a plurality of electricity-heat converters the discharging portion of the electricity-heat converter, or Japanese Patent Laid-Open Application No. 59-138461 which discloses having the opening for absorbing a pressure wave of heat energy correspondent to the discharging portion.

Further, as the recording head of the full line type having a length corresponding to the maximum width of recording medium which can be recorded by the recording device, either the constitution which satisfies its length by combination of a plurality of recording heads as disclosed in the above-mentioned specifications or the constitution as one recording head integrally formed may be used, and the present invention can exhibit the effects as described above.

In addition, the present invention is effective for a recording head of the freely exchangeable chip type which enables electrical connection to the main device or supply of ink from the main device by being mounted on the main device, or for the case by use of a recording head of the cartridge type provided integrally on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for the recording head, capping means, cleaning means, pressurization or aspiration means, electricity-heat converters or another heating element or preliminary heating means according to a combination of these, and it is also effective for performing stable recording in a preliminary mode which performs discharging separate from recording.

Further, as the recording mode of the recording device, the present invention is extremely effective for not only the recording mode only of a primary stream color such as black etc., but also a device equipped with different colors or full color by color mixing, whether the recording head may be either integrally constituted or combined in plural number.

As mentioned above, according to the present invention since the recording liquid discharge condition from each discharge openings can be accurately detected, it is possible to carry out the idle discharge operation the discharge openings whose discharge operation is bad. Consequently, the clogging can be effectively eliminated with a small quantity of consumption ink.

In addition, even when the clogging can not be eliminated by the idle discharge operation, the corresponding information can be obtained. As a result, the head can be cleaned off as occasion demands, thus the high quality recording image can be easily obtained.

What is claimed is:

1. A recovery method of an ink jet apparatus having plural discharge openings, a plurality of energy generators, each corresponding to one of said discharge openings, for generating energy utilized to discharge ink from a corresponding discharge opening to a recording medium in a recording mode and to idly discharge ink from said corresponding discharge opening in a non-recording mode, and a unit comprising a cap having an ink receiving member for receiving idly discharged ink, said method comprising the steps of:

providing detecting means for detecting an ink discharge condition of said discharge openings;

actuating said energy generators to perform a recovery operation by generating energy for idly discharging ink from all of said discharge openings in the non-recording mode into said unit;

using said detecting means to detect if ink is unsatisfactorily discharged from any of said discharge openings in the non-recording mode; and thereafter, without changing said unit to another unit, actuating only an energy generator corresponding to said discharge opening detected to have unsatisfactorily discharged ink to again generate energy for idly discharging ink in the non-recording mode from each such discharge opening into said unit.

2. A recovery method of an ink jet apparatus according to claim 1, wherein said first actuating step effects idle discharge, sequentially from an array of discharge openings positioned in a line, and the discharge condition is detected by detecting means disposed at both ends of the array of discharge openings.

3. A recovery method of an ink jet apparatus according to claim 1, wherein each said corresponding energy generator is actuated a plural number of times in said second actuating step.

4. A recovery method of an ink jet apparatus according to claim 1, further comprising a step of alarming an operator of an unsatisfactory discharge condition after the second actuating step.

5. A recovery method of an ink jet apparatus according to claim 1, wherein said first actuating step and said detecting step are performed in succession for each said discharge opening.

6. A recovery method of an ink jet apparatus according to claim 1, further comprising the steps of:

providing pressure generating means for generating pressure utilized to expel ink from said plurality of discharge openings; and after actuating said energy generator corresponding to any of said discharge openings detected to have unsatisfactorily discharged ink, actuating said pressure generating means to generate pressure to expel ink from said plurality of discharge openings if ink is still unsatisfactorily discharged from any of said discharge openings.

7. A recovery method of an ink jet apparatus according to claim 6, wherein said apparatus includes a recording head having an ink supply side from which ink is supplied to the recording head, and said pressure generating means generates pressure for pressurizing the ink in the recording head from the ink supply side.

8. A recovery method of an ink jet apparatus according to claim 6, wherein said pressure generating means generates pressure for sucking ink from said discharge openings.

9. An ink jet apparatus with a plurality of discharge openings for discharging ink therefrom, the apparatus comprising:

a plurality of energy generators, each corresponding to one of said discharge openings, for generating energy utilized to discharge ink from a corresponding discharge opening to a recording medium in a recording mode and to idly discharge ink from said corresponding discharge opening in a non-recording mode, and a unit comprising a cap having an ink receiving member for receiving idly discharged ink;

detecting means for detecting if ink is unsatisfactorily discharged from any of said discharge openings in the non-recording mode; and control means for controlling said plurality of energy generators to perform a recovery operation by generating energy for idly discharging ink from all of said discharge openings in the non-recording mode into said unit, wherein, without changing said unit to another said unit, said control means again actuates only an energy generator corresponding to any said discharge opening detected to have unsatisfactorily discharged ink to generate energy for idly discharging ink in the non-recording mode from each such discharge opening into said unit.

10. An ink jet apparatus according to claim 9, further comprising ink receiving means for receiving the ink idly discharged from said discharge openings.

11. An ink jet apparatus according to claim 10, wherein said ink receiving means includes a cap for covering the plurality of discharge openings.

12. An ink jet apparatus according to claim 9, further including a plurality of ink jet heads having said discharge openings.

13. An ink jet apparatus according to claim 12, wherein said ink jet heads discharge different colors of ink.

14. An ink jet apparatus according to claim 9, further including an ink jet head comprising a full-line head in which the plurality of discharge openings are aligned across an entire width of a recording area of the recording medium.

15. An ink jet apparatus according to claim 9, wherein said detecting means has a light emitting element and light receiving element.

16. An ink jet apparatus according to claim 9, wherein said detecting means is disposed at both ends of an array of said discharge openings.

17. An ink let apparatus according to claim 11, wherein said each energy generator is an electric-thermal converting member.

18. An ink jet apparatus according to claim 9, further comprising pressure generating means for generating pressure utilized to expel ink from said plurality of discharge openings, wherein said control means also actuates said pressure generating means to generate pressure to expel ink from said plurality of discharge openings if ink is still unsatisfactorily discharged from any of said discharge openings after said second actuation.

* * * * *

UNITED STATES PATENT AND TRADEMARK OFFICE

CERTIFICATE OF CORRECTION

PATENT NO. : 5,530,462

DATED : June 25, 1996

INVENTORS : HARUHIKO TAKAHASHI ET AL.

It is certified that error appears in the above-identified patent and that said Letters Patent is hereby corrected as shown below:

ON THE TITLE PAGE:

At [56] References Cited U.S. Patent Documents, insert
-- 4,518,973 /1985 Tazaki ..... 346/140R
4,723,129 2/1988 Endo et al. ..... 346/1.1
4,740,796 4/1988 Endo et al. ..... 346/1.1
4,558,333 12/1985 Sugitani et al. ..... 346/140
4,459,600 7/1984 Sato et al. ..... 346/140
4,176,363 11/1979 Kasahara ..... 346/140--.

At [56] FOREIGN PATENT DOCUMENTS
Insert --FOREIGN PATENT DOCUMENTS
318329 5/1989 European Patent Office
3523428 1/1987 Germany
59-123670 7/1984 Japan
59-138461 8/1984 Japan--.

SHEET 2, FIGURE 2:

"RECEIVE" should read --RECEIVING--.

COLUMN 1:

Line 40, "low" should read --a low-- and "in" (second occurrence) should be deleted.

UNITED STATES PATENT AND TRADEMARK OFFICE

CERTIFICATE OF CORRECTION

PATENT NO. : 5,530,462

DATED : June 25, 1996

INVENTORS : HARUHIKO TAKAHASHI ET AL.

It is certified that error appears in the above-identified patent and that said Letters Patent is hereby corrected as shown below:

COLUMN 1 (cont'd)

Line 45, "port The" should read --port. The--.
Line 49, "by" should be deleted.
Line 57, "apparat,us" should read --apparatus--.

COLUMN 2:

Line 24, "securely" should read --reliably--.
Line 65, "sponges" should read --sponges,--.
Line 67, ".." should be deleted.

COLUMN 3:

Line 59, "a" should read --an--.

COLUMN 5:

Line 3 "2" should read --a--.
Line 6, "opening," should read --openings,--.

COLUMN 6:

Line 44, "so" should read --so- --.
Line 48, "nucleus" should read --nucleate--.
Line 49, "an" should be deleted.

UNITED STATES PATENT AND TRADEMARK OFFICE

CERTIFICATE OF CORRECTION

PATENT NO. : 5,530,462

DATED : June 25, 1996

INVENTORS : HARUHIKO TAKAHASHI ET AL.

It is certified that error appears in the above-identified patent and that said Letters Patent is hereby corrected as shown below:

COLUMN 7:

Line 2, "orifice. The" should read --orifice, the--.
Line 4, "right angle" should read --right-angle--.
Line 11, "the" should read --as the--.
Line 17, "full line" should read --full-line--.
Line 50, "openings" should read --opening--.
Line 51, "operation" should read --operation only for--.
Line 56, "can not" should read --cannot--.

COLUMN 8:

Line 16, before "said" insert --any--.
Line 22, "charge," should read --charge--.

COLUMN 9:

Line 12, "said unit," should read --unit,--.
Line 13, "said" should be deleted.

UNITED STATES PATENT AND TRADEMARK OFFICE

CERTIFICATE OF CORRECTION

PATENT NO. : 5,530,462

DATED : June 25, 1996

INVENTORS : HARUHIKO TAKAHASHI ET AL.

It is certified that error appears in the above-identified patent and that said Letters Patent is hereby corrected as shown below:

COLUMN 10:

Line 13, "let" should read --jet-- and "claim 11," should read --claim 9,--.

Signed and Sealed this

Thirty-first Day of December, 1996

*Attest:*

*Attesting Officer*

BRUCE LEHMAN

*Commissioner of Patents and Trademarks*